US008286617B2

(12) United States Patent
Grady

(10) Patent No.: US 8,286,617 B2
(45) Date of Patent: Oct. 16, 2012

(54) DUAL COIL IGNITION

(76) Inventor: John K. Grady, Harvard, MA (US)

( * ) Notice: Subject to any disclaimer, the term of this patent is extended or adjusted under 35 U.S.C. 154(b) by 43 days.

(21) Appl. No.: 12/977,455

(22) Filed: Dec. 23, 2010

(65) Prior Publication Data

US 2012/0160222 A1 Jun. 28, 2012

(51) Int. Cl.
*F02P 3/045* (2006.01)

(52) U.S. Cl. ..... 123/605; 123/609; 123/618; 123/622

(58) Field of Classification Search ..... 123/601, 123/605, 609, 611, 618, 634, 621, 622
See application file for complete search history.

(56) References Cited

U.S. PATENT DOCUMENTS

| | | | | | |
|---|---|---|---|---|---|
| 3,452,733 | A | * | 7/1969 | Eckert | 123/620 |
| 3,910,247 | A | * | 10/1975 | Hartig | 123/634 |
| 4,059,084 | A | | 11/1977 | Jundt | |
| 4,285,321 | A | * | 8/1981 | Phelon et al. | 123/599 |
| 4,462,380 | A | * | 7/1984 | Asik | 123/620 |
| 4,463,744 | A | | 8/1984 | Tanaka et al. | |
| 4,478,201 | A | * | 10/1984 | Asik | 123/620 |
| 4,493,306 | A | * | 1/1985 | Asik | 123/620 |
| 4,631,451 | A | * | 12/1986 | Anderson et al. | 315/209 R |
| 5,107,817 | A | * | 4/1992 | Dittmann et al. | 123/643 |
| 5,140,970 | A | * | 8/1992 | Akaki et al. | 123/620 |
| 5,193,515 | A | * | 3/1993 | Oota et al. | 123/637 |
| 5,197,449 | A | * | 3/1993 | Okamoto et al. | 123/622 |
| 5,318,002 | A | * | 6/1994 | Okuda | 123/598 |
| 5,503,132 | A | * | 4/1996 | Miyata et al. | 123/630 |
| 5,586,542 | A | | 12/1996 | Taruya et al. | |
| 5,617,032 | A | * | 4/1997 | Inagaki | 324/399 |
| 5,692,484 | A | * | 12/1997 | Downey | 123/643 |
| 6,082,344 | A | | 7/2000 | Ito et al. | |
| 6,116,226 | A | | 9/2000 | Vogel | |
| 6,405,708 | B1 | | 6/2002 | Watson | |
| 6,539,930 | B2 | | 4/2003 | Inagaki | |
| 6,666,196 | B2 | | 12/2003 | Skinner et al. | |
| 6,701,904 | B2 | * | 3/2004 | Lepley | 123/604 |
| 7,353,813 | B2 | * | 4/2008 | Shiraishi | 123/634 |
| 7,506,641 | B2 | * | 3/2009 | Ishida | 123/618 |
| 7,796,004 | B2 | * | 9/2010 | Matsubayashi et al. | 336/90 |

* cited by examiner

*Primary Examiner* — Hai Huynh
(74) *Attorney, Agent, or Firm* — Donald S. Holland, Esq.; Holland & Bonzagni, P.C.

(57) ABSTRACT

Applicant has disclosed an improved dual cycle ignition system for automobiles. In the preferred embodiment, the improved ignition system comprises at least two secondary ignition coils wired in a high voltage "OR" configuration using a single high voltage circuit through a distributor, or alternatively a single plug operated directly from diodes connected respectively to associated secondary coils. The ignition coils are set up to alternate sparks, so that even at 8000 engine RPM, each coil is firing as if operating at 4000 RPM, a speed where conventional highly optimized and inexpensive coils are very effective and can reach their full output.

3 Claims, 6 Drawing Sheets

DUAL COIL IGNITION

FIELD OF INVENTION

The present invention relates generally to ignition systems for automobiles. More particularly, the invention relates to automotive coil ignitions.

BACKGROUND OF INVENTION

Automotive ignitions have evolved through many iterations, and the field is well understood with much prior art.

The design eventually evolved to a standard jump spark "ignition coil" and "distributor" with "points", by 1920. Later electronic switches were used. This remained the standard for almost 80 years: it is simple, reliable and cost effective. Systems that use other concepts, such as capacitor discharge, are not discussed here; they are not widely used.

As engine speeds rose, or more cylinders were added, an inherent problem or limitation of this design began to limit automotive performance. The standard ignition coil operates by building up a certain magnetic field, which takes some finite time, and the ignition coil stores energy in that field. The field is then suddenly collapsed, by the points opening (or equivalent), causing the spark. The spark may be 50-100 microseconds long (i.e., the collapse time). But the buildup time, set by the basic L/R (where L=inductance of coil; R=resistance) inherent time constant of the primary coil, is milliseconds long.

A small inductance implies less energy, so there is little to be gained in that direction in an attempt to shorten the storage time, without causing a smaller spark. The resistance can be increased, leading to so called "ballast resistors" in series with the coil, especially on 12-volt systems, by 1955. This approach wastes about half the energy as heat in the resistor, but improves the L/R time constant, allowing higher RPM without compromise of spark intensity. The field will build faster, but the maximum current is reduced, reducing the spark energy which is given by $\frac{1}{2} LI^2$, where L=inductance and I=current. Many compromises result from this, with little real gain.

These same concerns are why V12 or V16 engines of the 30's and 40's typically had two distributors and two coils. This allows each coil to build up longer, as if it were on a 6-cylinder engine. Yet the coil is on a V12. However, that approach doubles the ignition system cost and complexity.

There were also attempts in the 40's and 50's in the racing field to operate two coils through one special V8 distributor cap with two sets of points opening alternately. This system, called "DUCOIL", required a special distributor of difficult design with two rotors and two high voltage inputs. While the DUCOIL functioned well, it had little commercial success due to complexity, and it required two timing settings.

Finally, with computer control inherent in engines from the 90's forward, there has been a trend to use four or eight coils (i.e., "coil on plug"). That operates flawlessly, as there is plenty of time to build up the magnetic field with only one spark per revolution (or every other revolution) versus four or eight sparks per revolution on a V8 with one coil.

But this coil on plug is very expensive, as it requires not only four or eight coils but also the same number of associated high speed solid state power switches. It may draw a lot more electrical power, unless elaborately controlled buildup "on" time or duty cycle control is added. Such a controlled "on" time will be a function of engine RPM at least.

However, coil on plug is the standard approach today, despite the cost, as a single ignition on a V8 coil has proven marginal given emission issues.

There have been several patented designs using diodes in the high voltage leads of an ignition coil. For example, in U.S. Pat. No. 6,666,196 to Skinner ("Skinner") the diodes are arranged not to direct the main spark, but to prevent an unwanted misfire or weak spark that can happen when the coil is first energized (called a "make spark" due to origins in point ignition). These diodes are described by Skinner as "less than 10 kV rated", indicating no attempt to steer or hold off a 50 kV main spark; rather they conduct the main spark as if they were not there, but delete an inverse or "make spark".

U.S. Pat. No. 5,586,542 to Taroya discloses an alternative method to suppress the make spark. U.S. Pat. No. 5,675,072 to Yasuda discloses a way to monitor the spark event status via a "sampling" diode, again without a spark directing function. U.S. Pat. No. 6,082,344 to Ito also discloses a method to suppress the make spark, this time by Zener diodes.

In U.S. Pat. No. 6,116,226 to Vogel, a high voltage switch (e.g., a Silicon Controlled Rectifier) is used to suppress the make spark, and to shorten the spark duration as the current tails off.

Applicant's present invention has no active switches in the high voltage; the above-listed U.S. Pat. No. 6,186,130 to Skinner has a similar goal (i.e., measuring spark current to determine an early cutoff point) but cuts off the primary current to allow beginning the building up sooner, for the next spark. This Skinner patent is an attempt to solve the same problem Applicant's two coil concept addresses successfully—the problem of the L/R time constant, by starting buildup as soon as possible. However, in Skinner, the L/R problem is still present with the one coil, even with elaborate electronic microprocessor control; it cannot be fully overcome.

U.S. Pat. No. 6,539,930 to Inagaki is also concerned with make spark suppression, combined with event monitoring and does not use two coils.

U.S. Pat. No. 6,405,708 to Watson discloses a method to fire one coil or ignition transformer, per cylinder; this single coil has dual outputs to fire two spark plugs at once; it is still a single core transformer, and such a coil, still with the L/R buildup problem, is well known from, e.g., motorcycles. But with typically fewer cylinders L/R is not a problem. U.S. Pat. No. 6,834,640 to Nishizawa also describes one coil per cylinder, and control means active to sense misoperation of the ignition event. Finally, U.S. Pat. No. 4,059,084 to Junot discloses adding a primary higher voltage to the ignition coil from a second low voltage energy storage coil. This is also an attempt to solve the L/R time constant problem, but Junot still describes a single high voltage ignition coil and no high voltage diodes.

In summation, although high voltage diodes are at times present, in the prior art, the purpose is either "make spark" suppression or monitoring the spark event.

Combining the interleaved alternating output, of the two or more independent coils using "OR" diodes into one HT ("high tension") output lead, with a control to alternate the coil operation apparently has not been described.

Accordingly, it is a primary object of the present invention to provide an improved automotive ignition which overcomes the aforementioned problems in the prior art.

It is another primary object to provide a dual coil ignition system, commensurate with the above-listed object, which overcomes the prior L/R problem by alternately firing the coils.

It is a more specific object to provide a dual coil ignition system which combines the interleaved alternating output, of the independent coils using "OR" diodes into one HT output lead, with a control to alternate the coil operation.

SUMMARY OF INVENTION

Applicant has disclosed an improved dual coil ignition system for automobiles. Applicant's ignition system comprises: at least two secondary coils, wherein the secondary coils are wired in a high voltage "OR" configuration using a single high voltage circuit through a distributor, or alternatively a single plug directly from the two secondary coils. Applicant's preferred embodiment, hooked up to a 12-volt car battery, comprises: at least two primary coils designed to be wound around respective cores; at least two secondary coils designed to be wound around respective primary coils; at least two high voltage diodes, wherein each diode is associated with at least one secondary coil and one side of each diode is common; a control circuit, sensitive to the desired ignition, with at least two output switches; and at least one spark plug; wherein the switches are electrically operated so as to alternate the current between the primary coils to increase the time (i.e., increase buildup time in each ignition coil) for coil spark operation, compared to the standard single coil Kettering cycle used in most automobiles today.

BRIEF DESCRIPTION OF DRAWINGS

The above and other objects will become more readily apparent when the following description is read in conjunction with the accompanying drawings, in which.

DETAILED DESCRIPTION OF PREFERRED EMBODIMENTS

Figure 1:
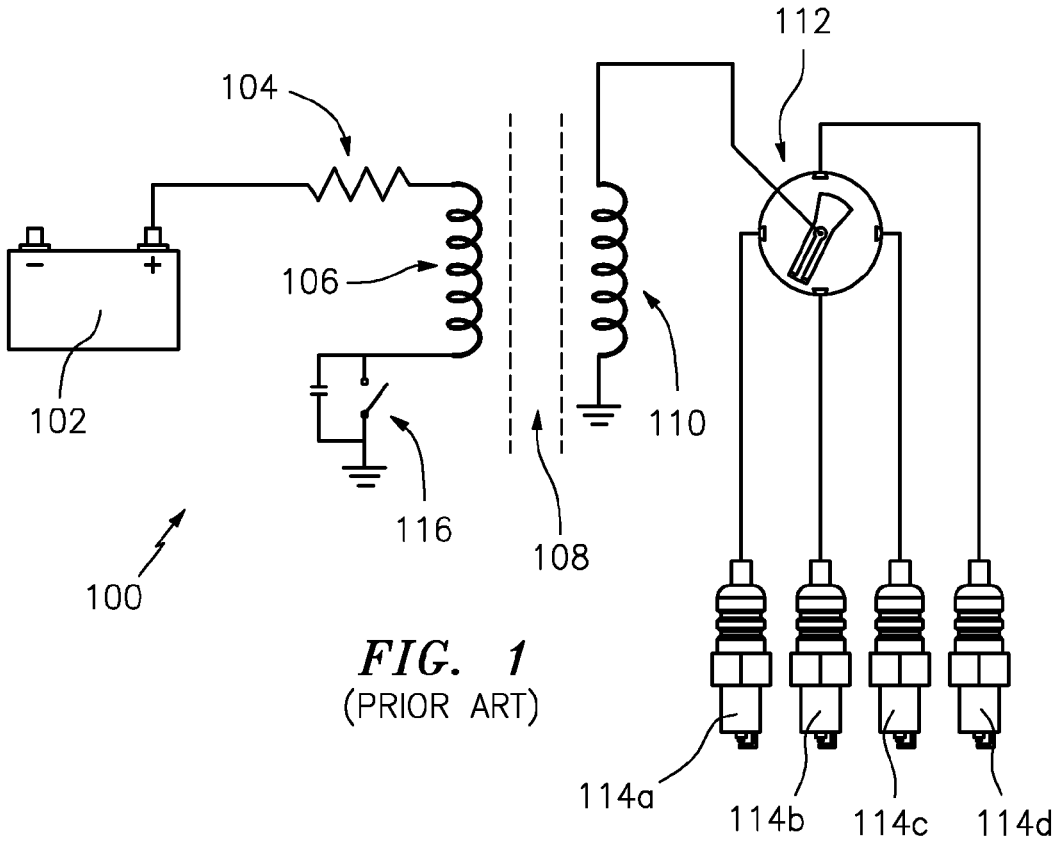
FIG. 1 (PRIOR ART)
FIG. 1 is a circuit diagram for a standard Kettering ignition system for automobiles.

FIG. 1 depicts a circuit for a standard Kettering ignition system 100 used for most automotive engines. This conventional ignition system 100 comprises: a 12V DC battery 102, a resistor 104, a primary coil 106 designed to be wound around a core 108 (separately shown); a single secondary coil 110 designed to be wound around the primary coil 106; a distributor 112 with points which produce the sparks for spark plugs (e.g., 114*a*, 114*b*, 114*c*, 114*d*); and an ignition switch 116. Though not shown, the secondary coil 110 has hundreds of times more turns of wire than the primary coil 106. This conventional ignition system is also called a single coil ignition system.

During operation of the Kettering ignition system 100: Switch 116 closes, prompting a flow of current through the core 108. Current rises in the primary coil 106 to a maximum set by circuit resistance after L/R time (L=inductance of primary coil 106; R=resistance). Switch 116 opens. A magnetic field of the primary coil 106 collapses rapidly. Secondary coil 110 is engulfed by a powerful and changing magnetic field. This field induces a current in the secondary coil 110—a high voltage current, up to 50,000 V, because of the high number of windings in the secondary coil. The secondary coil 110 feeds this voltage to the distributor 112, which sends a spark to an associated spark plug (e.g., 114*a*).

Resistor 104 limits the current and improves L/R time. L is set inherently by the design of primary coil 106.

Figure 1A:
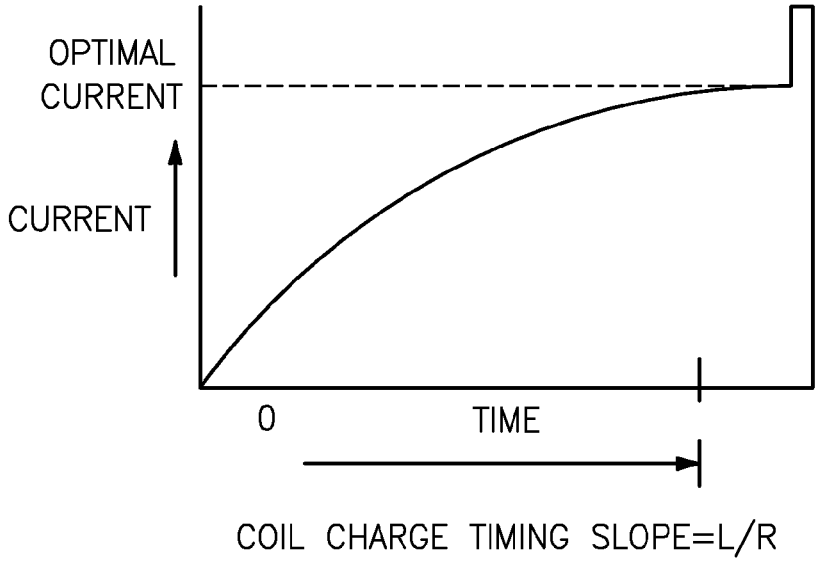
FIG. 1A is a chart showing the charge timing slope for a single secondary ignition coil in FIG. 1.

FIG. 1A is a chart showing the charge timing slope for Kettering's single coil ignition system 100. The chart plots current (X axis) versus charge (Y axis). It shows the optimal current.

Applicant has disclosed an improved dual coil ignition system 200 for (e.g., Otto cycle) engines in automobiles, which overcomes the prior L/R problem by alternately firing the coils.

It occurred to the Applicant that a simple diode OR "switch" on the high-voltage side of multiple coils (i.e., the secondary coils) could add the output of such coils into one "output" lead that then operates through a standard single rotor distributor, like distributor 112 in the Kettering ignition system 100. The secondary coils would be typically set up to alternate sparks, so that even at 8000 engine RPM, each secondary coil is firing as if operating at 4000 RPM, a speed where conventional highly optimized and inexpensive coils are very effective and can reach their full output.

Figure 2:
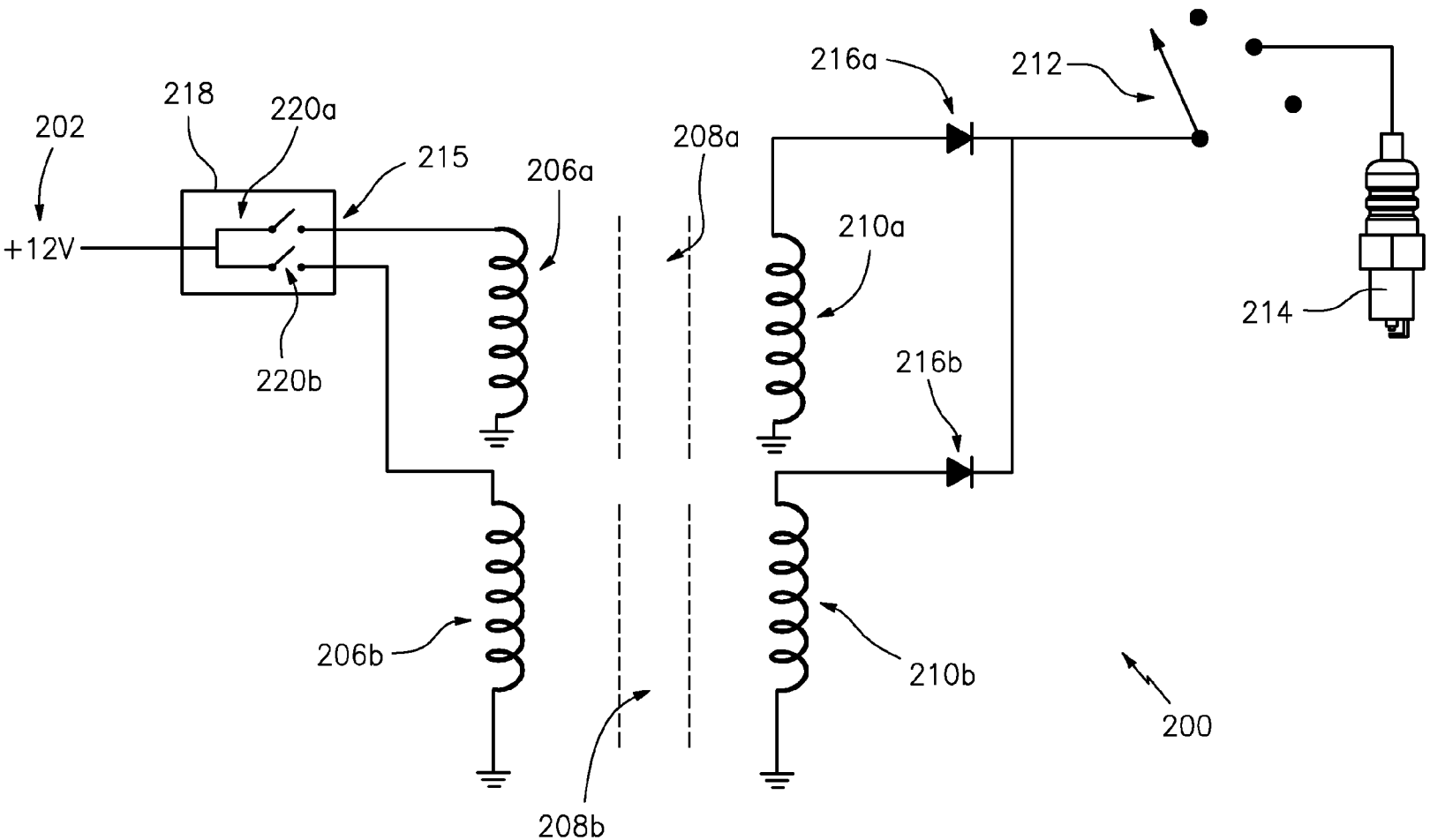
FIG. 2 is a circuit diagram of an preferred embodiment of Applicant's "Improved Dual Coil Ignition" for automobiles.

That recognition led eventually to Applicant's preferred dual coil ignition system 200, shown in the FIG. 2 circuit. Though not shown, FIGS. 1 and 2 share many of the same components of the low voltage side, such as a 12V DC battery, a resistor, and an ignition switch.

Applicant's preferred ignition system 200, hooked up to a standard 12V car battery (at 202), comprises: at least two primary coils (e.g., 206*a*, 206*b*), wherein each primary coil is designed to be wound around an associated core (e.g., 208*a*, 208*b*); at least two secondary coils (e.g., 210*a*, 210*b*), wherein each secondary coil is designed to be wound around an associated primary coil (e.g., 206*a*, 206*b*); at least two high voltage diodes (e.g., 216*a*, 216*b*), wherein each diode is associated with at least one secondary coil and one side of each diode is common; any suitable circuit control means, sensitive to the desired ignition, for applying electrical current alternately to each of the primary coils (e.g., 206*a*, 206*b*) to increase dwell time of the current in each of the primary coils (e.g., 206*a*, 206*b*) before coil spark operation occurs in each of the secondary coils (e.g., 210*a*, 210*b*); and a spark plug (e.g., 214);

The depicted circuit control means is a control circuit 215, sensitive to the desired ignition timing, with an input pulse divider 218 (e.g., a common 4000 Series CMOS Divider Chip Model No. CD4013B manufactured by Fairchild Semiconductor) having at least two output switches (e.g., 220*a*, 220*b*); wherein the switches (e.g., 220*a*, 220*b*) are electrically operated so as to alternate the current between the primary coils (e.g., 206*a*, 206*b*), and indirectly the secondary coils (e.g., 210*a*, 210*b*), to increase the time (i.e., increase buildup time in each coil) for coil spark operation compared to the standard single ignition coil in Kettering.

In Applicant's preferred dual coil ignition 200, there are "N" secondary coils (wherein N=the number of ignition coils and N is greater than 1) are connected in parallel through secondary diodes. The ignition coils (e.g., 210*a*, 210*b*) can also be operated in a sequential or simultaneous manner, thereby creating sequential full energy sparks during one single cylinder ignition event. HV diodes (e.g., 216*a*, 216*b*), preferably one for each secondary coil (e.g., 210*a*, 210*b*), can also be connected in a full wave bridge as in 316*a*, 316*b*. This allows alternate reverse polarity operation of any ignition coil (e.g., 308*a*, 308*b*), and the primary control circuit system 215 or 318 to accomplish that function.

Current in FIG. 2 is directed alternately to primary coils (e.g., 206*a*, 206*b*), and indirectly to secondary coils (e.g., 210*a*, 210*b*), due to the input pulse divider 218. Since each primary coil (e.g., 206*a*, 206*b*) has twice as much time to charge up its own field, any L/R limitations appear at an RPM twice as high as the single primary coil 110 in the depicted Kettering ignition circuit (FIG. 1). The diodes (e.g., 216*a*, 216*b*) combine the outputs of charged secondary coils (e.g., 210*a*, 210*b*) into a single high voltage lead, which is then sent to a standard distributor, such as distributor 112 in the Kettering circuit.

During operation of Applicant's preferred dual coil ignition system 200: Both points 220*a* and 220*b* are closed. Current is supplied alternately to primary coils (e.g., 206*a*, 206*b*). Magnetic field builds in the primary coils (e.g., 206*a*, 206*b*). One set of points 220*a* then opens. Secondary coil 210*a* fires via diodes 216*a*. Coil 205*b* is still closed during this firing. Points 220*a* close by control 218 closing primary coil 206*a*. Primary coil 206*b* is still closed during the secondary coil 210*a* firing event. Magnetic field builds in coil 206*b*. Points 220*b* open. Secondary coil 210*b* fires via diode 216*b*. Primary coil 206*a* is still closed during this firing, and rebuilding its charge. By this sequence, the dwell time in each coil to build the magnetic energy for a spark event is twice that of Kettering's single coil ignition system 100, doubling the effective RPM.

Figure 3A:
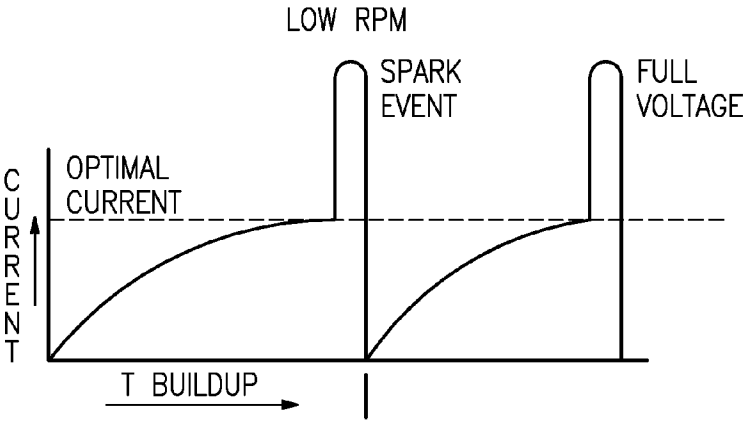
FIGS. 3A and 3B are a side-by-side two-chart comparison of the buildup timing, at low and high RPM respectively, of the single secondary ignition coil in the circuit of FIG. 1.
Figure 4A:
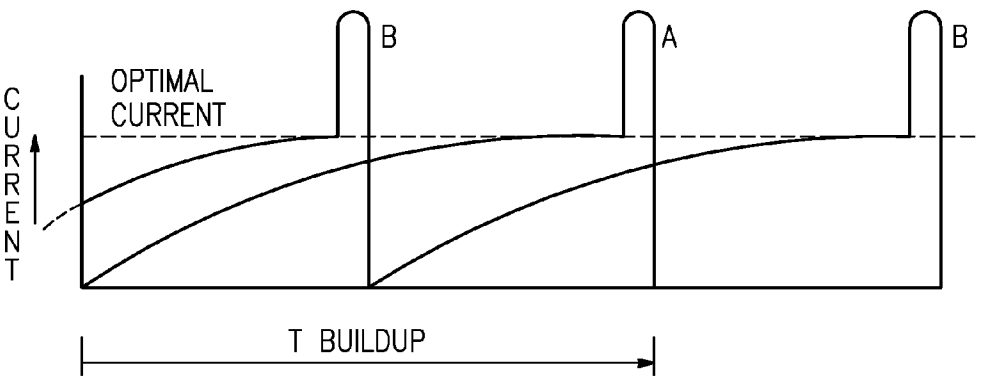
FIGS. 4A and 4B are a side-by-side two-chart comparison of the buildup timing, at low and high RPM respectively, of dual secondary coils in the circuit of FIG. 2.

FIGS. 3A and 4A are a two-chart comparison of the coil buildup timing, at low RPM (i.e., from 500-4000 RPM), for Kettering's single coil ignition system 100 (see FIG. 3A chart) and Applicant's preferred dual coil ignition system 200 (see FIG. 4A chart). The charts plot current (Y axis) versus time buildup (X axis); and they show the optimal currents for both systems. Kettering's single coil system 100 generally works well at low RPM as shown in FIG. 3A.

Alternate slopes in the FIG. 4A chart represent the current buildups and spark events for Applicant's respective secondary coils 210*a*, 210*b*. The time buildup for each coil 210*a*, 210*b* is approximately twice that for Kettering's single coil 110*a*.

Figure 3B:
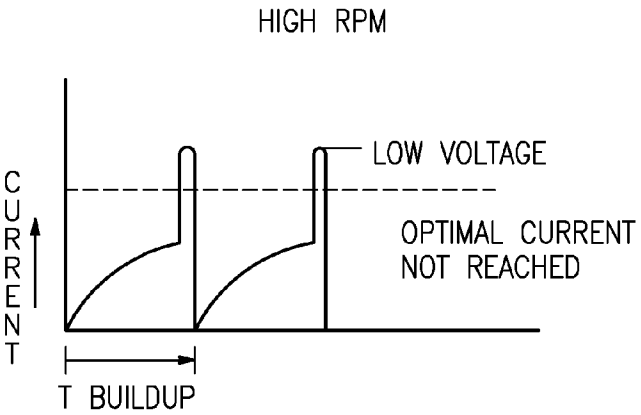
Figure 4B:
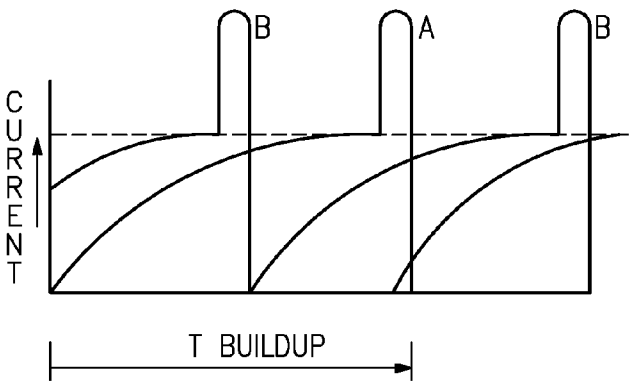

FIGS. 3B and 4B are a two-chart comparison of the coil buildup timing, at relatively high RPM (i.e., from 4000-8000 RPM), for Kettering's single coil ignition system (see FIG. 3B chart) and Applicant's dual coil ignition system (see FIG. 4B chart). The charts again plot time buildup (X axis) versus current (Y axis); and they show the optimal currents for both systems. Similarly, alternating slopes in the FIG. 4B chart represent Applicant's respective secondary coils 210*a*, 210*b*.

Looking at FIG. 3B, Kettering's single coil system 100 is not fully charged at some higher RPM reducing the output energy. This causes misfires, skipping and emission problems. Applicant's dual coil system 200 operates without the problems, at high RPM, because of the impact of alternating the current between at least two primary coils (e.g., 206*a*, 206*b*) and indirectly each associated secondary coil (e.g., 210*a*, 210*b*); each primary coil (e.g., 206*a*, 206*b*) has twice the time to charge. At high RPM the primary coils (e.g., 206*a*, 206*b*) are each operating as if the engine is turning half the RPM, as shown in FIG. 4B. There is no misfire for secondary coils (e.g., 210*a*, 210*b*) at higher speeds.

Figure 5:
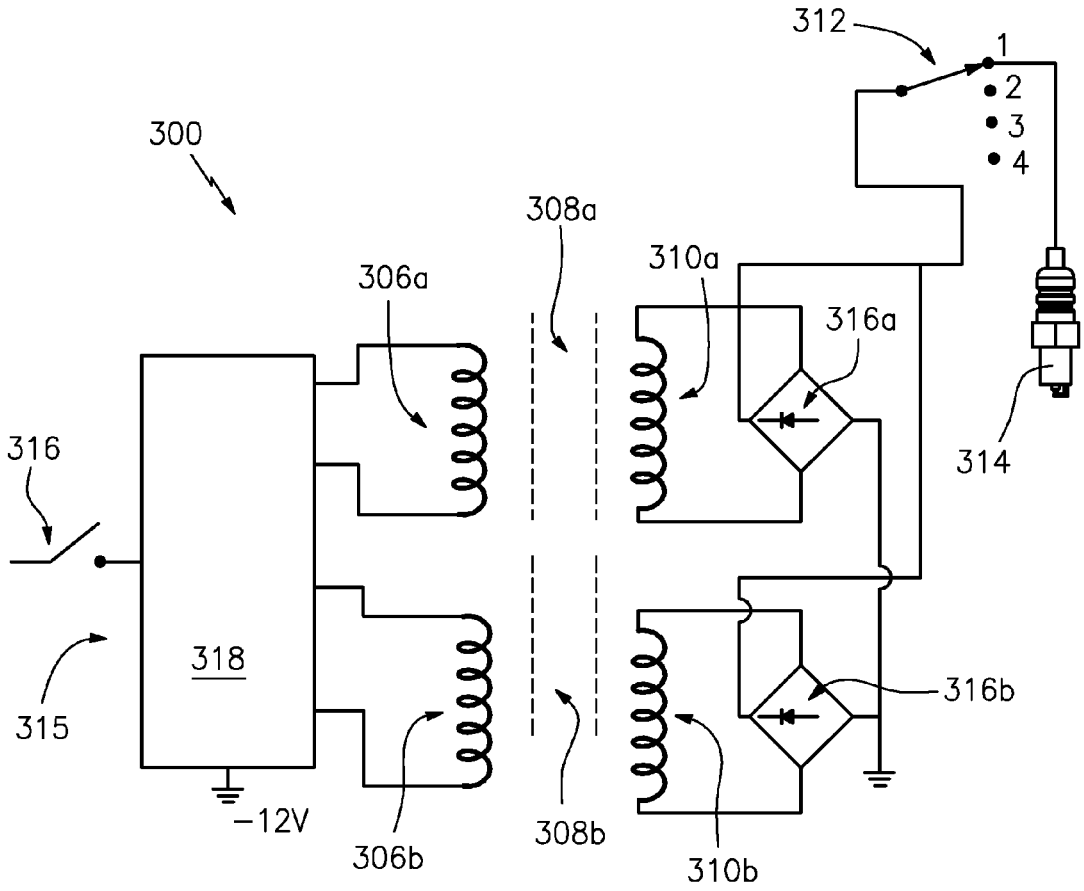
FIG. 5 is circuit diagram of Applicant's dual coil ignition concept used with alternating polarity of two primary coils while alternately firing associated secondary coils.
Figure 6:
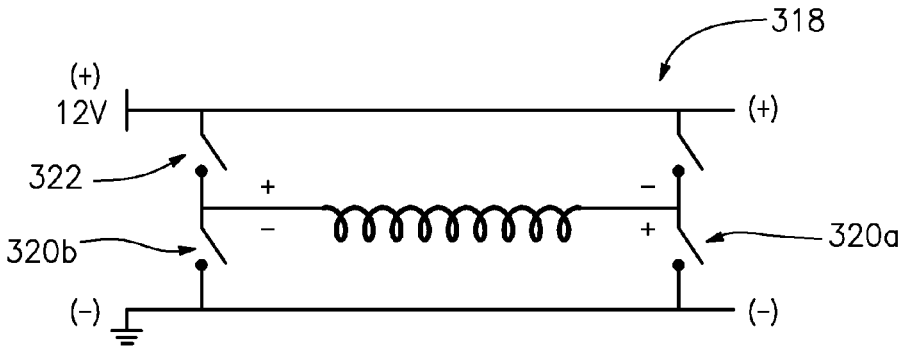
FIG. 6 depicts a phase inverter used for the circuit of FIG. 5.

FIGS. 5 and 6 depict an alternate embodiment 300 of Applicant's "Improved Dual Coil Ignition" which uses alternating polarity of at least two secondary coils (e.g., 310*a*, 310*b*) while alternately firing them. Since the polarity of the primary voltage of each of the two primary coils (e.g., 306*a*, 306*b*) alternates, this alternate embodiment 300 avoids magnetic saturation of the core material due to hysteresis, allowing a more powerful spark from a given physical coil. Otherwise, this embodiment 300 operates like Applicant's preferred embodiment 200. See Paragraph [0043] above.

Figure 7:
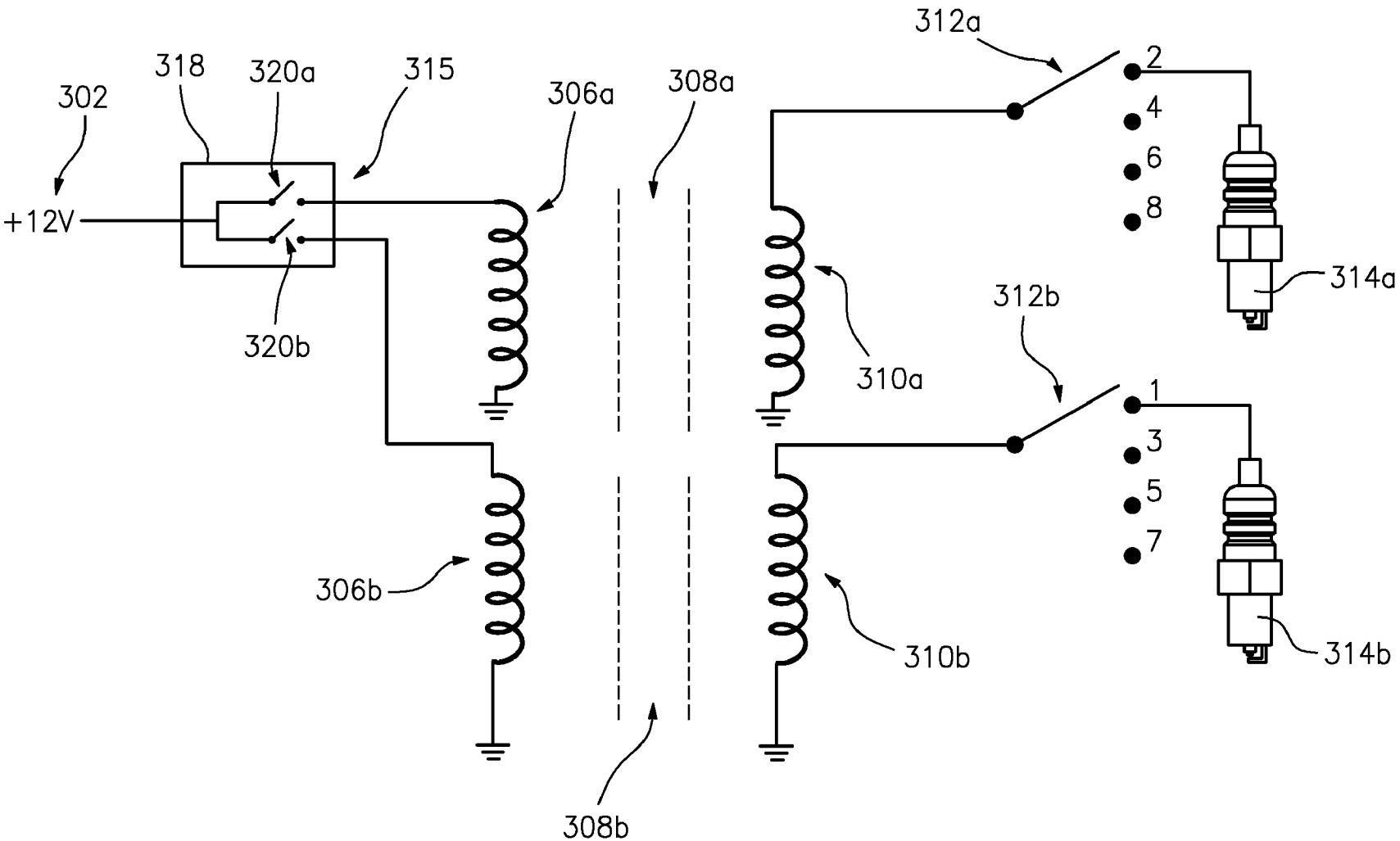
FIG. 7 depicts Applicant's dual coil ignition concept used with two distributor caps, one each for half the cylinders in an Otto engine.

FIGS. 5, 7 share many of the same parts with Applicant's preferred dual coil embodiment 200. Like parts are referenced by the prefix 300 in FIGS. 5, 7 rather than the prefix 200. For example, secondary coils 210*a*, 210*b* are labeled 310*a*, 310*b* in FIGS. 5, 7.

As depicted, the alternate embodiment 300 of Applicant's automotive ignition system comprises: at least two primary coils (e.g., 306*a*, 306*b*); at least two ignition coils (e.g., 310*a*, 310*b*); at least two high voltage diodes (e.g., 316*a*, 316*b*) wherein each diode is associated with at least one secondary coil and one side of each diode is common; and any suitable circuit control means 315, such as the depicted control circuit 315 with a suitable divider 318, sensitive to the desired ignition point, for alternating or dividing in time the coil spark operation.

A bridge configuration of high voltage diodes, shown in FIG. 5, is needed as the output of each secondary coil (e.g., 310*a*, 310*b*) reverses polarity, and this bridge must be connected as shown to implement the "OR" function.

There is also a known preferred direction or polarity to fire a spark plug. At the top of the spark plug (e.g., 114*a-d*, 214, 314) sits the connector or terminal. This is where a spark plug wire attaches from the ignition circuit.

FIG. 6 depicts the preferred divider (a.k.a. alternator) 318 now, with a phase inverter 322, used in the control circuit of FIG. 5. Any suitable standard 2:1 divider 318 will suffice, such as Model No. CD4013B, manufactured by Fairchild Semiconductor, used with known power switches like FET's (field-effect transistors).

Divider 318 has two or more power switches (e.g., 320*a*, 320*b*) for two or more secondary coils (e.g., 310*a*, 310*b*). For very high RPM engines or racing, three or even four low-cost conventional coils can be used without the complexity or costs of coil on plug designs.

During operation, the divider 318 gives a command to apply the switch off signal alternately to the different primary coils (e.g., 306*a*, 306*b*). Otherwise, 12V is applied to both primary coils at all times. The physical opening of current can be in 12V power, or in the ground lead of each coil.

For racing, the secondary coils (e.g., 210*a*, 210*b*; 310*a*, 310*b*; 410*a*, 410*b*) can also be fired in a desired rapid 1-2 sequence, or even together at once to insure a hotter spark or a double spark closely spaced in time or giving extended spark duration. This array of applications is addressed easily by design of the primary switch logic and the number of coils.

It is also possible to fire the system alternately with two ignition timing sensors (not shown) and appropriate mechanical or electrical pickups (not shown) or provisions for same, eliminating the 2:1 divider requirement.

FIG. 7 depicts Applicant's dual coil ignition concept of FIG. 5 used with a divider 318 and two distributors 312*a*, 312*b*, one each for half (e.g., four) the cylinders in an engine. Representative plugs 314*a*, 314*b*, associated with distributors

312*a*, 312*b*, are also shown. Preferably, each distributor would power alternating cylinders.

Figure 8:
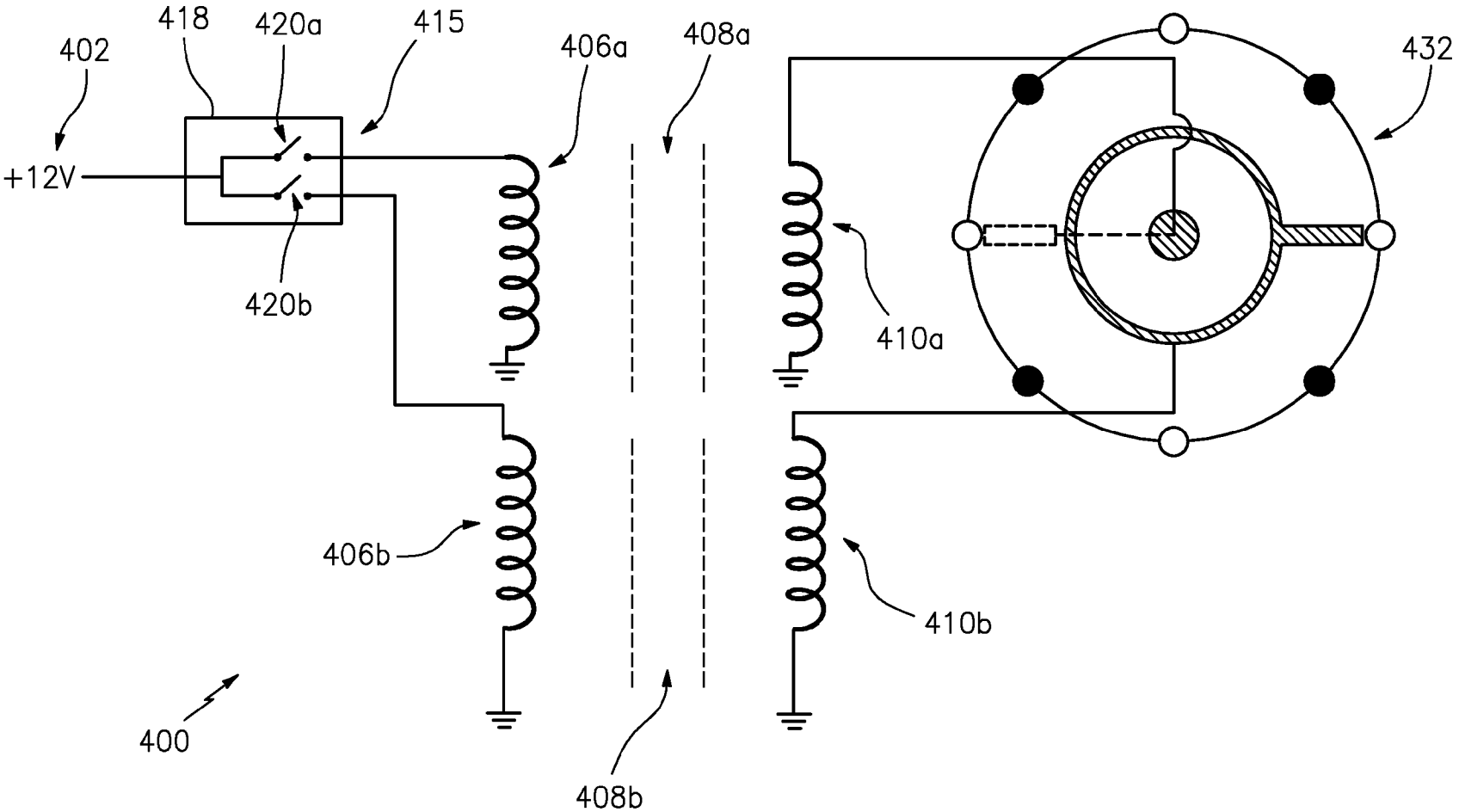
FIG. 8 depicts Applicant's dual coil ignition concept used with a dual circuit rotor.

FIG. 8 depicts an alternate embodiment 400 of Applicant's dual coil ignition concept, this time used with a dual circuit rotor 432. No diodes are used. Instead, the dual circuit rotor 432 fires two secondary coils (e.g., 410*a*, 410*b*) alternately by electronic control or sequential sensors, operating through two four-position distributions on an 8-cylinder engine. Though not shown, each of the rotor's distributor outputs (e.g., at 434) connects to a spark plug.

U.S. Pat. No. 6,186,130 to Skinner, described in Applicant's "Background of the Prior Art", has a similar goal of increasing the time to build up the coil primary current (i.e., measuring spark current to determine an early cutoff point) but does so by cutting off the primary current sooner to allow beginning the next build up event sooner, for the next spark, but still uses one ignition coil. In addition, unlike Skinner, Applicant's invention has no active switches in the high voltage side.

Combining the interleaved alternating output of two or more independent secondary coils using "OR" diodes into one HT ("high tension") output lead, with a control to alternate the coil operation, has not previously been done to the best of Applicant's knowledge.

Applicant's Improved Dual Coil Ignition can be thought of broadly as an automotive ignition circuit comprising:

a. at least two primary coils, wherein the primary coils are designed to be wound around associated cores;
b. at least two secondary coils connected in parallel through at least two diodes, wherein:
   i. each secondary coil is designed to be wound around an associated primary coil; and
   ii. one side of each of the diodes is electrically connected to a respective secondary coil and each diode has another side in common with the other diode;
a. control means for opening the electrical current alternately to each of the primary coils to thereby increase dwell time of the current in each of the primary coils before coil spark operation occurs in each of the secondary coils;
b. whereby each of the secondary coils can operate at 8000 engine RPM as if operating at substantially 4000 engine RPM, without associated spark plugs misfiring.

Additional features of the invention can be thought of as:

a. the control means includes a control circuit and a divider having at least two output switches, whereby the switches are electrically operated by the control circuit to alternate which coils are used to divide in time the coil spark operation.

It should be understood by those skilled in the art that obvious structural modifications can be made to the Improved Dual Coil Ignition, beyond those noted above, without departing from the spirit of the invention. Accordingly, reference should be made primarily to the accompanying claims rather than the foregoing description to determine the scope of the invention.

I claim:

1. In an automotive ignition system having a 12V DC battery, a resistor, and a ignition switch, connected in series in an electrical circuit, the improvement comprising:

a. two primary coils, wherein each of the primary coils is designed to be wound around an associated core;
b. two secondary coils connected in parallel, in an electrical circuit, through at least two diodes, wherein:
   i. each of the secondary coils is designed to be wound around an associated primary coil; and
   ii. one side of each of the two diodes is electrically connected to a respective secondary coil and each of the two diodes has another side in common with the other of the two diodes;
c. control means for opening the electrical current alternately to each of the primary coils to thereby increase dwell time of the current in each of the primary coils before coil spark operation occurs in each of the secondary coils;
d. whereby each of the secondary coils can operate at 8000 engine RPM as if operating at substantially 4000 engine RPM, without associated spark plugs misfiring.

2. The ignition system of claim 1 further comprising a distributor with two high voltage paths that connects the at least two secondary coils alternately to at least two spark plugs.

3. The ignition system of claim 1 further comprising: wherein the control means comprises a divider having at least two output switches, whereby the switches are electrically operated by the control circuit to alternate which of the primary coils is used before coil spark operation occurs in an associated secondary coil.

* * * * *